US006244019B1

(12) United States Patent
Ljungqvist et al.

(10) Patent No.: US 6,244,019 B1
(45) Date of Patent: Jun. 12, 2001

(54) SYSTEM FOR PACKING AND UNPACKING CAN LIDS

(75) Inventors: Ake Sigurd Ljungqvist, deceased, late of Norrahammer, by Inger Ljungqvist, legal representative; by Alf Ljungqvist, legal representative, Viiken; by Dan Ljungqvist, legal representative, Motala; by Jenny My Ljungqvist, legal representative, Jönköping; Weine Agne; Magnus Wigenstedt, both of Mullsjö, all of (SE)

(73) Assignee: Nordisk Platindustri Benetec AB (SE)

( * ) Notice: Subject to any disclaimer, the term of this patent is extended or adjusted under 35 U.S.C. 154(b) by 0 days.

(21) Appl. No.: 09/125,299

(22) PCT Filed: Feb. 14, 1997

(86) PCT No.: PCT/SE97/00233

§ 371 Date: Aug. 14, 1998

§ 102(e) Date: Aug. 14, 1998

(87) PCT Pub. No.: WO97/29956

PCT Pub. Date: Aug. 21, 1997

(30) Foreign Application Priority Data

Feb. 14, 1996 (SE) ..... 9600523

(51) Int. Cl.[7] ..... B65B 43/26
(52) U.S. Cl. ..... 53/386.1; 53/384.1; 414/411
(58) Field of Search ..... 53/492, 381.1, 53/381.2, 384.1, 386.1; 414/411, 412

(56) References Cited

U.S. PATENT DOCUMENTS 4,143,779 * 3/1979 Hachikawa et al. ..... 414/411
4,397,131 * 8/1983 Anderson ..... 53/386.1 X
4,938,649 7/1990 Ter Horst et al. .
5,275,524 * 1/1994 Ishiwata ..... 53/381.2 X
5,375,961 12/1994 Mojden et al. .
5,423,649 * 6/1995 Maeda et al. ..... 53/381.2 X

FOREIGN PATENT DOCUMENTS 0471773 2/1929 (DE) .
0663581 8/1938 (DE) .
1012223 12/1965 (GB) .
1189646 4/1970 (GB) .
2148234 5/1985 (GB) .

* cited by examiner

*Primary Examiner*—Linda Johnson
(74) *Attorney, Agent, or Firm*—Orum & Roth

(57) ABSTRACT

The present invention relates to packages for stacked can lids, a method of producing such packages, devices for implementing said method, devices for automated unpacking of the above nature and a system for packing and unpacking can lids. The packages are formed with an open end, which is closed in that the bag end, when in unfolded condition, is compressed and is provided with fastening means retaining said closed condition. In addition, the closing device closes the open package end by compressing the bag end in the unfolding condition and in that fastening means are applied retaining said closed condition, and the unpacking device causes relative movement of the packages and the can lids contained therein in such a manner that the can lids are pressed against the package end closed by means of said fastening means.

6 Claims, 8 Drawing Sheets

SYSTEM FOR PACKING AND UNPACKING CAN LIDS

TECHNICAL FIELD

The present invention relates to packages for stacks of can lids, a method of producing such packages, devices for performing the method, devices for automated unpacking of packages of the above kind, and a system for packing and unpacking can lids.

BACKGROUND

For instance within the brewing and food production industries are used mainly cans at least one of the ends of which is without a lid. Such lids are subsequently applied to the can e.g. by being clamped to the filled can. Like the rest of the cans such can lids more often than not are not manufactured at the place of filling and subsequent closure of the cans. In order to allow such can lids to be handled in a convenient manner, it is important that they are appropriately packaged. One important aspect is to ensure that the infeed of lids into the lid application and attachment apparatuses is simple, that the lids are prevented from turning, ensuring that they face the same direction during the filling and in that the lids are kept clean during transportation to avoid the risk that during filling the can contents will be polluted via the lids. The latter requirement could possibly be less severe, were the lids cleaned prior to application. However, such procedure is not common practise and the users require that the can lids, when delivered, are sufficiently clean to allow direct application.

For the above reasons can lids are since long packaged in elongate bags the internal circumference of which only slightly exceeds that of the can lids. For some time these bags have been made from paper, a material which has proved to operate well and which also is advantageous from an environmental point of view. One end of the bags is closed, normally by folding the bag end and gluing said folded end to the face of the bag. A varying number of can lids (normally 2–600) are then introduced into the bag through the open end thereof, whereupon also this bag end is closed and the now completely filled package is placed on loading pallets to be transported to breweries and other lid users. The closure of the open end through which the lids are inserted into the bag has been effected in many different ways over the years. An early and still very common method is to simply fold over the upper not filled length of the bag and to maintain the closed condition by depositing the bag on the pallet with the folded bag length facing downwards. In this manner a bag end self-locking effect is achieved, which functions satisfactorily when the packages are handled manually.

Gradually, however, an increasing number of the operational steps of the can lid handling process has been automated. Methods have been developed to automate e.g. the packaging of the can lids into bags and to position such bags on loading pallets. A device for this purpose is described for instance in the Applicant's Swedish Patent Application 9401920-5. As already mentioned, also the application of the lids onto the cans is effected by mechanical means. The automation has increased the requirement on package strength and consequently in principle the method used exclusively today is one which has existed and been used for several years, viz. gluing or taping of the folded-over end flap to the bag.

This method of packaging the can lids and above all the method used to close the packages does, however, involve several drawbacks. For instance the folded-over portion of the bags gives the bags an uneven thickness which in turns causes problems when the bags are to be palletised. In addition, this closing method makes it difficult to develop methods for automated opening of the bags and emptying the lids into the lid application apparatus. However, attempts have been made to automate also this step of the handling process. Devices designed for this purpose are described for instance in the U.S. Pat. Nos. 4,997,329 and 4,245,946. In the first mentioned specification is described a manner for cutting open the bag along its entire length, whereupon the can lids may be removed from the bag. The latter specification describes a devise allowing the closure to be opened by pulling apart the glue bond between the folded-over flap and the bag, whereupon the lids may be withdrawn from the bag through the same opening as that through which they were inserted, A common feature found in both these prior-art devices is, however, that they are expensive and complicated to manufacture (particularly the latter one) and above all, that the reliability of the devices is poor, which cannot be accepted by the users as this causes recurrent disruptions of the processes. Consequently, only a small number of the users employ apparatuses of this or similar type whereas the absolute majority of the users still open the bags and charge the can lids into the lid-application apparatuses manually.

OBJECT OF THE INVENTION

One object of the present invention thus is to provide a can lid package which is easier to stack on loading pallets and easier to open by automated means, a method of packaging can lids in said package, a device to perform the method and a reliable and simple device for automated unpacking of the can lids by the user.

These objects are achieved by the invention defined in the appended claims.

DESCRIPTION OF PREFERRED EMBODIMENTS

Figure 1A:
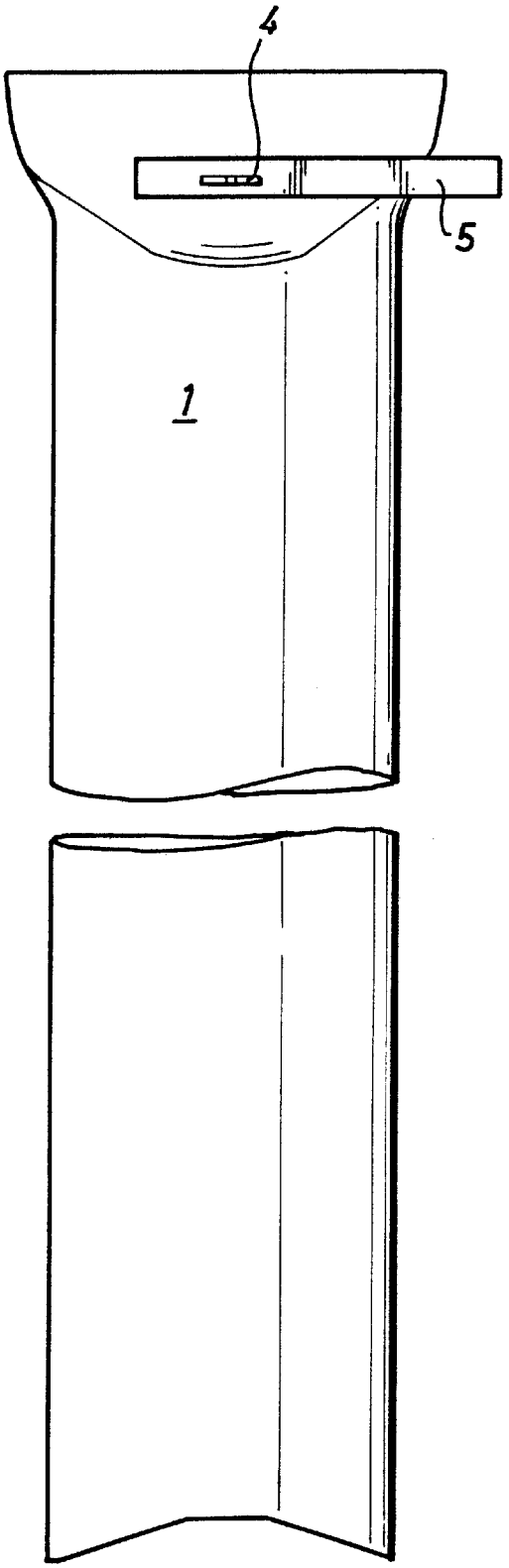
FIGS. 1*a* and 1*b* illustrate a package intended for stacks of can lids in accordance with the invention, as seen from different directions.
Figure 1B:
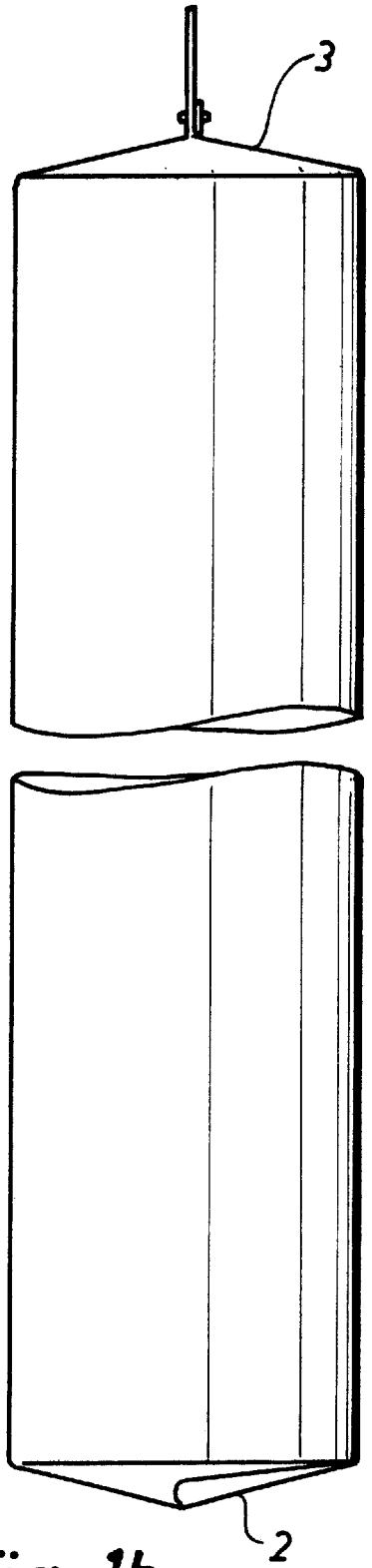

FIG. 1 illustrates a package 1 for stacks of can lids. The package is configured as an elongate bag, preferably made from paper, but also plastics and other similar materials are possible, one short end 2 of said bag having been closed previously. Such closure is effected e.g. by an end portion of the bag being compressed and folded over into abutment against the rest of the bag and secured in this position by gluing. The internal circumference of an expanded bag somewhat exceeds the circumference of the can lids which it is intended to contain. The opposite bag end 3 is closed by compression of the bag end length projecting beyond the can lids inserted into the bag, into an essentially flat condition, whereupon a staple 4 is pressed through the bag end portion, the staple leg ends being folded inwards against the bag material on the opposite side of the bag. Preferably, the staples 4 are positioned, relatively close to the can lids inside the bag in order to prevent them from being disarranged and rotating during transport.

Advantageously, a strip of tape 5 is positioned on one side of the bag intermediate the staple 4 and the bag 1. The purpose of the strip is to ensure that the staple 4 remains safely in position on one of the bag sides as the bag mouth is being opened up. This feature is of considerable importance, since any staple 4 which separates from the bag and thus may fall into the interior of a can containing a soft drink or food may cause considerable concern and may lead to large claims for damages against those responsible for the contents of the cans. In addition, the strip 5 serves to facilitate opening of the bag manually, since a simple pulling action exerted on the strip piece is sufficient to pull open the bag. The strip may be made from plastics, paper or any other suitable material.

The bag need not be closed by a staple but other closing means are possible. For instance, other kinds of rivets would serve the purpose as would gluing by means of a heat cured glue or the like.

Figure 2:
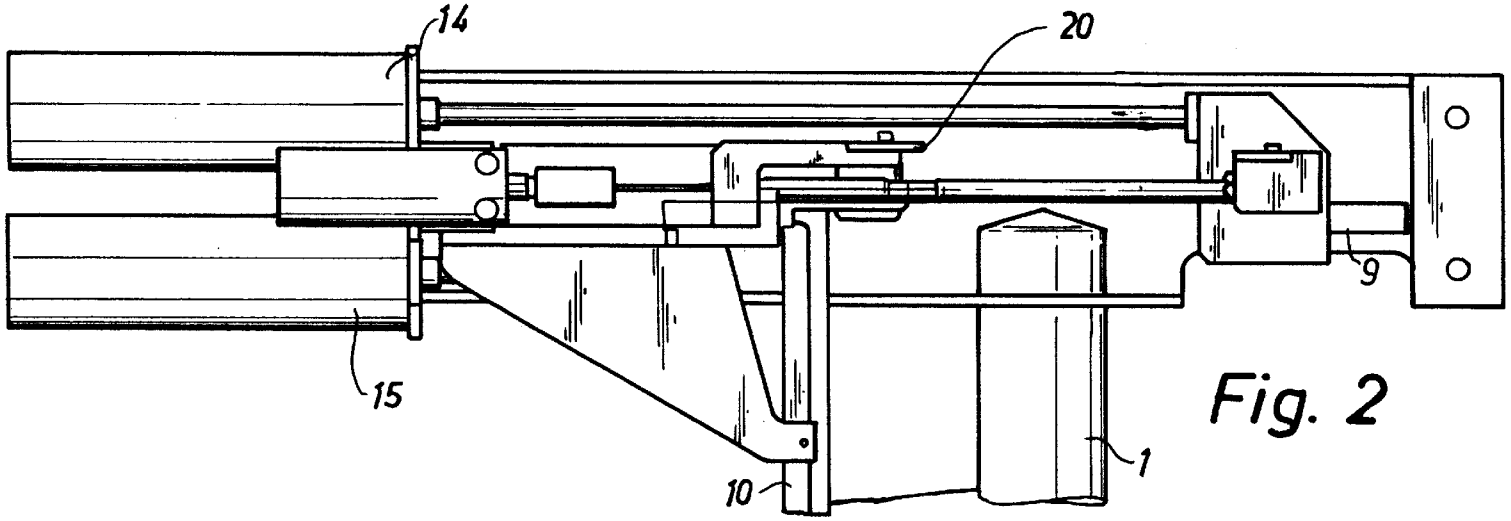
FIG. 2 illustrates a device for closing packages of the above kind, the view being seen perpendicularly to the extension of the package.
Figure 3:
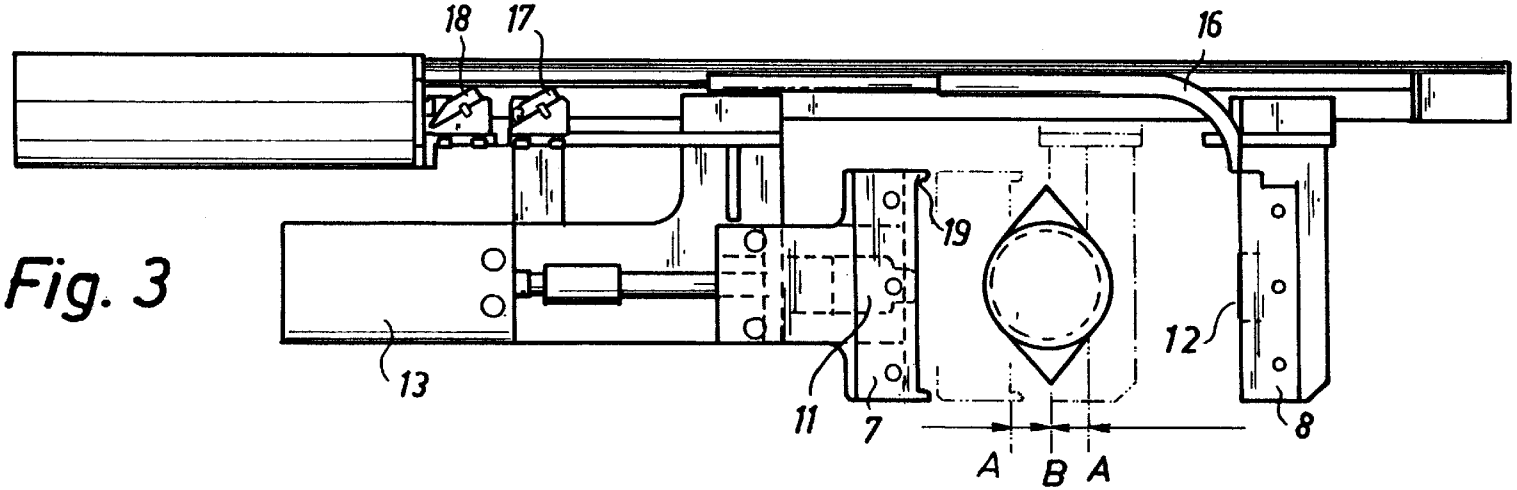
FIG. 3 illustrates the device of FIG. 2 in a view as seen in the length direction of the package.
Figure 4:
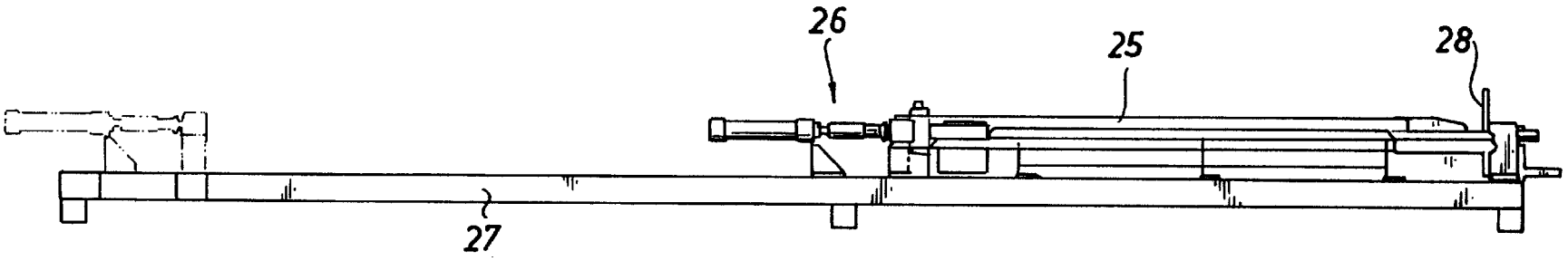
FIG. 4 illustrates a first embodiment of a device for unpacking can lids from a package of the above kind, in a lateral view.

To obtain the closure as indicated above by automatic means a device as illustrated in FIGS. 2 and 3 may be used. This apparatus is conceived for co-operation with an apparatus designed for automatic filling the bags 1 with can lids. An empty bag is positioned with its open end in the bag-mouth closing device. A piston means (not shown) is then moved to its extended position, forcing can lids into the bag in a manner known per se. After introduction of the can lids, jaws 7, 8, movably supported on guides 9, are extended into engagement with the partly unfilled and still open mouth end of the bag 1. The jaws project sufficiently far to either side of the bag bars to prevent the can lids inside the bag from tipping over and falling out. This position is indicated in FIG. 3 as position A. The projecting piston means is then retracted and the jaws may be moved to their completely closed position, i.e. to the position illustrated in FIG. 3 by reference B. As they are thus moved, the jaws compress the bag end length to an essentially flat condition. The jaws are actuated by piston-and-cylinder units 14, 15, preferably pneumatically operated, but also other varieties, such as hydraulically operated piston units or equivalent means, obviously are possible.

In position B of the jaws a stapler 11 actuated by a piston-and-cylinder unit 13 and mounted on one of the jaws advances, ejecting the foremost staple in a staple magazine 10. The legs of the staple are forced through the material of the compressed bag and are then bent towards one another on the other side of the bag by means of a stapler pad 12 arranged on the opposite jaw. After closure of the bag end length, the jaws are retracted to their original position and the finished can lid package may be palletised for transportation.

In addition, one of the jaws is equipped with a cutter blade 20 on the side facing away from the bag whereas the opposite jaw is equipped with an equivalent cutting edge. In this manner the superfluous material of the bag end length that projects past the jaws is cut off as the jaws meet (position B) . This is advantageous since, owing to the varying heights of the stacks of lids, the bags may be filled to different degrees and the superfluous part of the bag end may be inconvenient, both when the packages are arranged on loading pallets but above all when the can lids are unpacked preparatory to use.

A tape may be conducted through a channel 16 up to one of the jaws 7, 8 from a tape storage (not shown). In accordance with the shown embodiment the tape is carried up to the jaw 8 supporting the stapler pad 12 but the tape could equally well be supplied from the opposite side. The tape is carried to a position opposite the stapler pad 12 and is penetrated by the staple legs before the latter are bent towards one another. In addition, one of the jaws is equipped with a tape cutter blade 19 on the side facing the tape channel 16. A corresponding cutting edge is provided on the opposite jaw. In this manner a suitable length of tape is cut off as the jaws meet (position B).

The tape is advanced by means of spring-actuated return-movement blocking means 17, 18 which press against the tape, allowing it to move only forwards, towards the jaws 7, 8. The locking means 17 nearest the jaws is connected to one of the movable jaws whereas the second blocking means 18 is immobile. In this manner, the return-movement blocking means 17 carries the tape along as the jaws move towards one another. As the jaws are moved apart the other blocking means 18 prevents the tape from being carried along in the return movement of the blocking means 17.

Other types of tape advancement means axe obviously possible, for instance roller or squeeze mechanisms of some kind may be used.

When a loading pallet is completely filled with can lid packages the palletised load is enclosed in plastics foil for supplementary protection against dirt and pollution and is thereafter transported to the user.

At the user end the can lids may be unpacked and filled into can filling and closing apparatuses manually or automatically. In manual unpacking the protruding part or the tape may be used as a pull tab to open up the bag mouth closure, whereupon the can lids may be poured into a filling channel in the apparatus. From a capacity as well as a cost point of view it is, however, a considerable advantage to make this process automatic, especially if such automation prevents the lid e.g. from turning, presenting the wrong face to the machine.

To construct devices suitable for the type of packages used so far has, as mentioned above, proved to be very difficult. However, this new packaging method has made it possible to construct comparatively simple and operationally very reliable devices.

A first and a second embodiment of such a device will be described in the following. The first embodiment of the device is illustrated in FIGS. 4–7. The device comprises a channel 25 for reception of the unopened package. A stop means 28 is provided at one end of the channel against which the package rests. Preferably, the channel 25 may also be inclined, allowing the packages to slide by gravity into rest against the stop means 28. The opposite end of the channel is equipped with a bag stripper or debagging device 26 which by means of guides 27 is moveable towards and away from the channel, essentially in the direction of the channel 25. The function of the bag stripper or debagging device is shown in more detail in FIGS. 5–7.

At the bag stripper end suction holders 30, 31 are arranged for movement perpendicularly towards the channel 25, preferably by means of pneumatically operated piston-and-cylinder units which by e.g. pumps or the like are connected thereto hold the article in front by suction. In addition, the ends 32, 33 of the holders 30, 31 that are turned away from the channel 25 are bent at an angle inwards, towards the channel. Following the suction holders 30, 31 as seen from the channel 25, rollers 34, 35 are positioned on either side of the channel so as to be movable towards and away therefrom, and following the rollers, the bag stripper 26 or debagging device. The latter means, which is movable towards and away from the channel 25 on guides 27 comprises on the one hand pulling means 36, 37 and on the other a suction rod 38. A suction rod 38 is displaceable by a piston-and-cylinder unit 39 so as to be extendible and retractable towards and away from the channel 25 in the direction of the latter, and by connection of the suction rod to a pump or a similar means the front end of the rod serves as a suction cup. The rod 38 could instead be equipped with clamping means, holding the bag end length by clamp action, and pulling it along in its retracting movement. The pulling means comprises two clamping jaws 36, 37 which may be displaced towards and away from each other perpendicularly to the direction of the channel 25.

Figure 5:
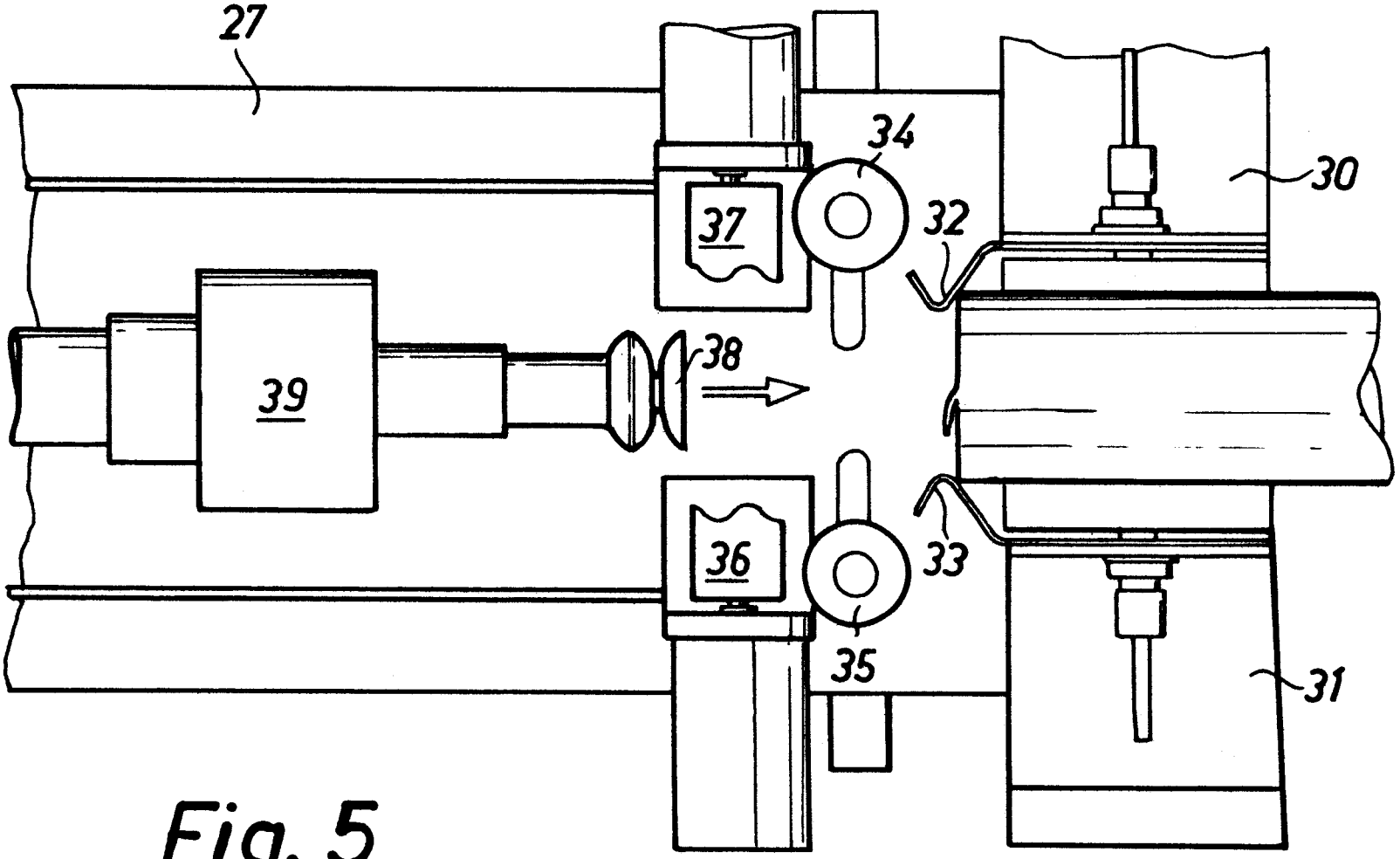
FIG. 5 illustrates a part of a device of FIG. 4, illustrating a first unpacking step.

In a first step illustrated in FIG. 5 a package is received in channel 25 in such a manner that its end that is closed by e.g. a staple faces away from the bag stripper 26. The suction holders 30, 31 thereafter are extended towards the rear end of the package, holding the latter. The suction of the holders 30, 31 holds only the package as such and not the can lids contained therein. The rollers 34, 35 as well as the pulling means 36, 37 assume their retracted positions away from the channel 25.

Figure 6:
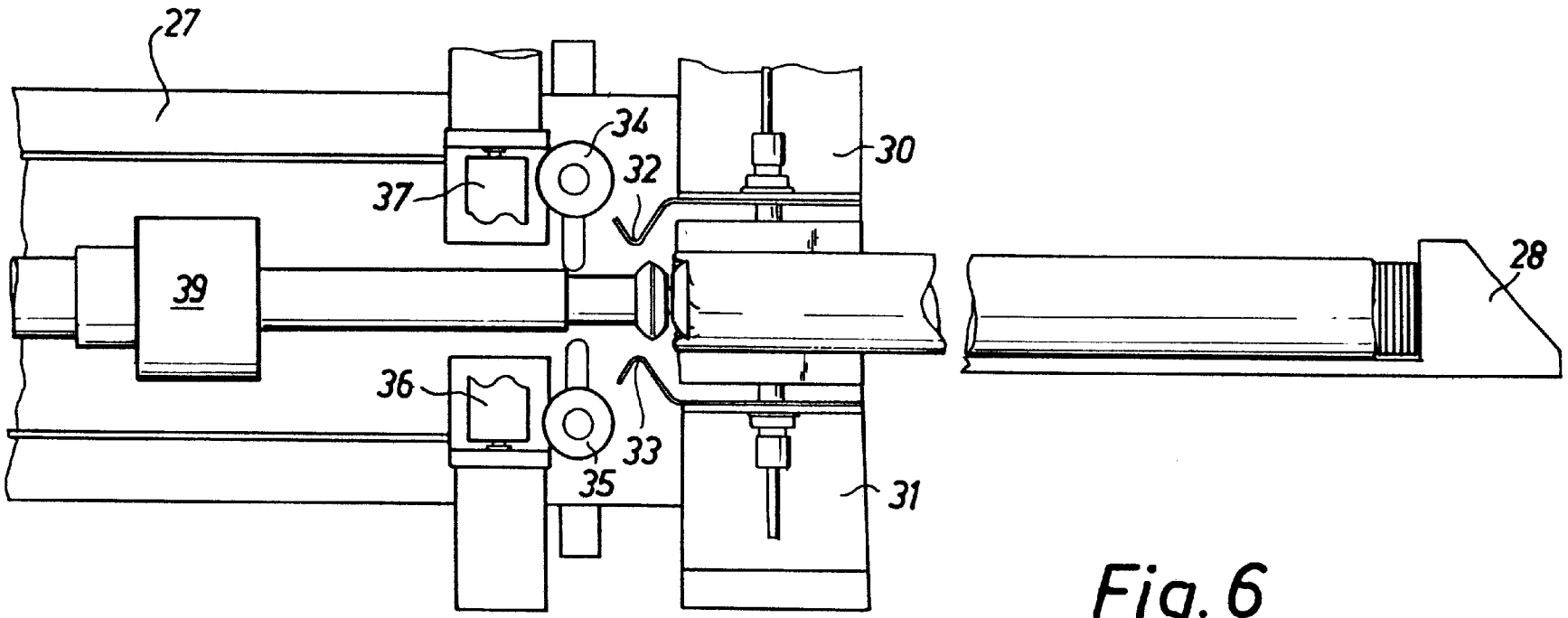
FIG. 6 is a part of the device of FIG. 4, illustrating a second unpacking step.

Thereafter, the suction rod 38 is extended to a position in abutment against the package, which is now hold fast, as illustrated in FIG. 6. As a result, the can lids are urged forwards while at the same time the package is retained in position by the suction holders 30, 31. Owing to the relative force generating between the package and the can lids contained therein the closure means is forced to come loose and the package is opened. The front stop means 28 does, however, prevent the can lids from falling out and from turning or assuming some other inappropriate position. Once the closure means has come loose the suction rod is retracted and the package is pulled rearwards owing to the suction effect of the rod 38. In this position, the inwardly bent end portions 32, 33 of the holders 30, 31 prevent the can lids from falling. The suction rod 38 together with the package is retracted to a position rearwardly of the pulling means 36, 37.

Figure 7:
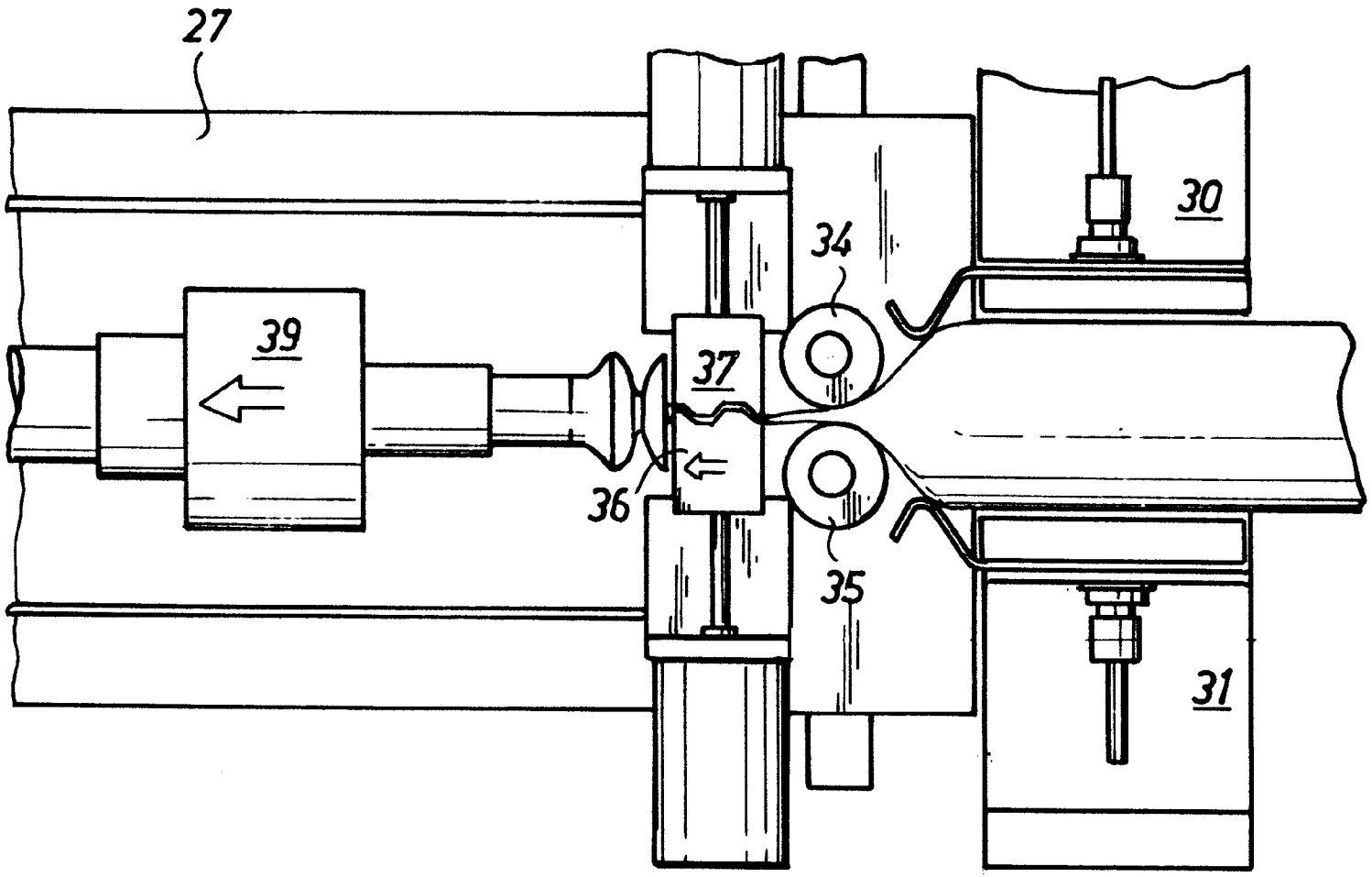
FIG. 7 illustrates a part of the device of FIG. 4, illustrating a third unpacking step.

The pulling means 36, 37 and the rollers 34, 35 subsequently are extended towards the package, whereupon the suction holders 30, 31 are retracted, away from the package as illustrated in FIG. 7. In this position, it is instead the rollers 34, 35 that prevent the can lids from falling off. Simultaneously, the pulling means 36, 37 when forced together, clamps the package. Advantageously, the meeting surfaces of the means 36, 37 may be serrated, knurled, or otherwise configured in order to enhance the holding power.

Finally, the entire bag stripper 26 is pulled along the guides together with a package whereas the rollers prevent the can lids from taking part in the movement, thus ensuring that the can lids are separated entirely from the package. The package, now empty, may thereafter be removed, a step which has not been illustrated, and the can lids may be advanced to the filler and lid-application apparatus, which is not either illustrated. The latter step could be effected for instance by prolonging the channel beyond the stop means 28 such at it leads straight in to the apparatus (in which case the stop means preferably is movable).

A second and simplified embodiment of the unpacking device is illustrated In FIGS. 8–12.

Figure 8:
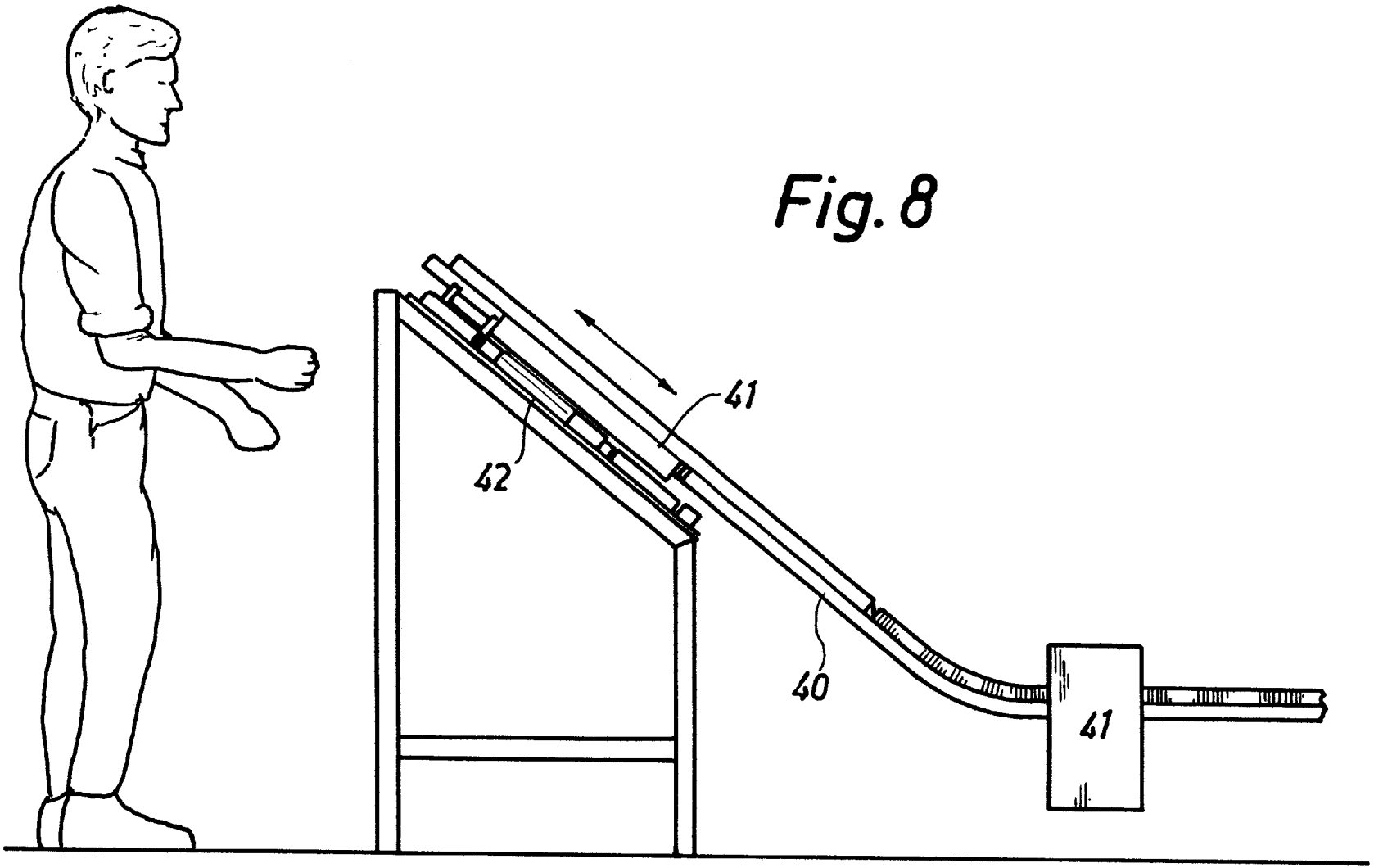
FIG. 8 illustrates a second embodiment of an unpacking device.
Figure 9:
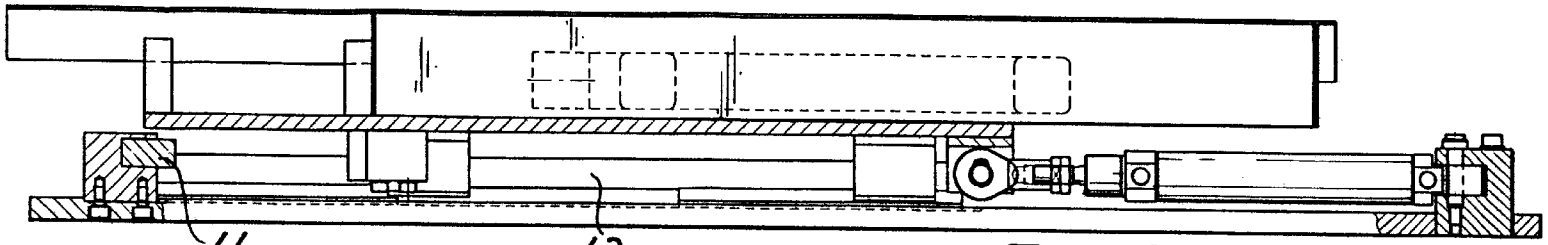
FIG. 9 is an enlarged view as seen from one long-side, of a part of the device of FIG. 8.
Figure 10:
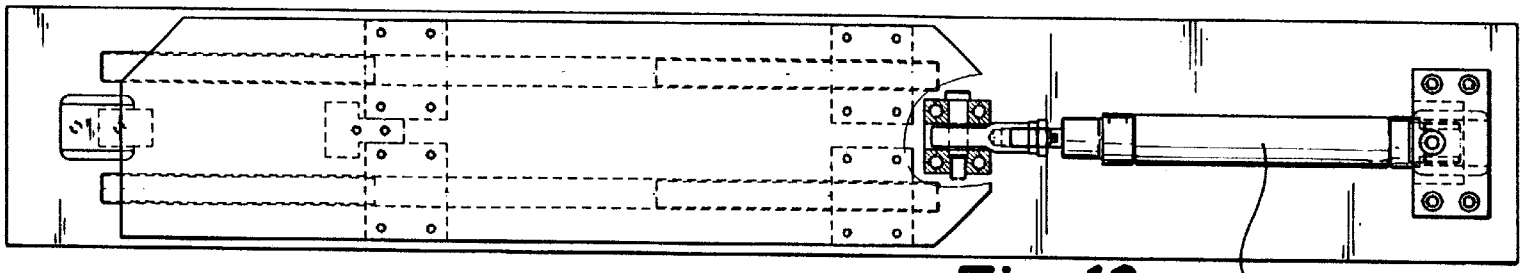
FIG. 10 is a view from above of the device of FIG. 9 but without the infeed unit 41 and FIG. 11 is a view as seen from above of the device of FIG. 9.
Figure 11:
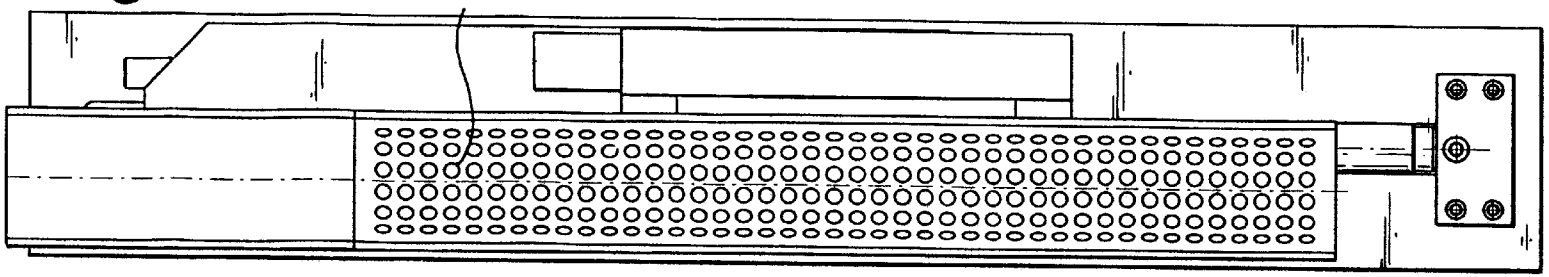

Like the apparatus in accordance with the first embodiment the second apparatus comprises a channel 40 which in this case, as is illustrated in FIG. 8, via an in-feed unit 41 leads to the filler and lid-application apparatus. At least a part of the channel ahead of the in-feed unit 41 preferably is inclined to provide automatic advancement of the can lids. A part of this sloping channel further comprises a suction holder means 42 which in a similar manner to that described above, by being connected to a pump or similar means, holds the article resting on the suction holder means 42 by means of suction. The suction holder 42 preferably comprises a frictional surface which may be e.g. rubber coated, and a plurality of comparatively small suction apertures that are distributed across the surface. Further, the suction holder is movable on guides 42 in the direction of the channel. Additionally, the suction holder 42 is connected to a piston-and-cylinder unit 43 arranged to transfer an impulse to the suction holder, imparting a motion the latter along the guides 42. The end of the guides 42 a stop means preferably is arranged to prevent the suction holder from travelling too far.

When this variety of the device is used a package with can lids contained therein is positioned in the channel 40, the bag mouth, which is closed for instance by a staple, being positioned facing downwards. The packages may be positioned in this manner either manually or automatically. The package will slide down the channel so as to rest against the queue or stack of can lids already positioned inside the channel. In a certain position, and while the package still remains above the suction holder 41, the latter is activated, thus holding the package. As described above, the suction holder holds only the package as such and not the can lids contained therein. The suction holder then is given an impulse from the piston unit 43. Owing to the inertia, the can lids will act on the closure of the package, prying the latter open, by a force the size of which depends on the weight of the lids, the inclination of the channel and the force of the transferred impulse. Thus, the can lids will slide out the package, the latter still being held by the suction holder, and the lids will be positioned in the queue of stacked lids. Should the distance between the package and the queue of stacked can lids ahead be restricted the lids will not have time to turn or be disaligned as they slide out of the package.

Obviously, it is likewise possible to have the lids slide out of the bags in a separate channel and thereafter be transferred to the continued process.

Varieties of this embodiment may include for instance the suction holder 41 initially assuming an upper position whereupon it is allowed to slide downwards, and the impulse instead being transferred through the deceleration caused by the impact of the suction holder 41 against the stop member at the end of the guides.

This second embodiment is easier to manufacture and to use and consequently less expensive. In some cases, for instance when the lids are made from a very light material, when closures of particularly high strength are required, or when small series of can lids are used, the first embodiment is preferable, however, since the second embodiment does not guarantee the same excellent results.

The third embodiment of the unpacker in accordance with the invention comprises means to weaken the package end. Means of this kind may include for instance a perforating serrated wheel which is moved around the periphery of the package. The serration advantageously is configured in such a manner that the teeth are adapted to penetrate between two can lids contained inside the package. The perforation of the package by means of the serration weakens the package, with the result that the can lids, when exerting pressure against the package end, will cause the package to break along the weakened line. A maximum weakening effect will be achieved in the areas of single layer packaging material and minimum in areas of double or triple layer material. If the perforation lines are made in an area of the package where the material thickness varies along the circumference, the package will break at the place of minimum material thickness whereas the package will still be coherent in areas of thicker material. This unpacking device is advantageously used for traditional can lid packages, the end length of which is folded back along the package and glued in position or otherwise secured. After the perforation of the package the thickest part thereof thus will be the end length that does not abut against the rest of the package. This is advantageous, since after the breaking up of the package, the bag end length will be brought along with the rest of the package as the latter is being removed.

Obviously, there are other ways of ensuring unequal weakening of the package along its circumference; for instance it is possible to perforate the package along only a part of the circumference.

Other means for obtaining partial weakening of packages obviously are possible, such as by means of knife blades, penetrating needles or the like.

Several varieties of the invention described above are possible, and several modifications have already been mentioned. Such obvious modification must be regarded as falling within the scope of the invention as the latter is defined by the appended claims.

What is claimed is:

1. A device for unpacking can lids packaged in an elongated bag, said bag including at least one closed end, the closed end being closed by means for closing a bag end, comprising:

at least one retaining suction element which through suction directly holds said bag, and a rod which is extendible relative to the retaining suction element in the elongation direction of the package for causing relative motion of said bag and said can lids contained therein by the pushing force of the rod applied on one end of said bag as a result of the extension of the rod, in such a manner that said can lids are forced by the motion of the rod towards the other closed bag end, causing said bag to open.

2. A device as claimed in claim 1, wherein the retaining suction elements are movably arranged on guides, which are arranged in the elongation direction of the package, and in that piston-and-cylinder units are provided for causing considerable acceleration of said elements.

3. A device as claimed in claim 1, wherein the rod extendible relative to the retaining suction element in the direction of the package, and in that said rod is arranged to bring along said package rearwards by suction, in its retracting movement.

4. A device as claimed in claim 3, wherein it further comprises pulling means (36, 37) arranged to squeeze and pull along the package, and rollers (34, 35) allowing said package to be pulled therebetween while at the same time preventing can lids from being entrained together with a package.

5. In combination, a device for unpacking can lids packaged in a bag comprising:

an elongated bag having closed ends;

a strip of tape secured to an end of said bag;

at least one retaining suction element which through suction directly holds said bag; and a rod which is extendible relative to the retaining suction element in the elongation direction of the package for causing relative motion of said bag and said can lids contained therein by the pushing force of the rod applied on one end of said bag as a result of the extension of the rod, in such a manner that said can lids are forced by the motion of the rod towards the other closed bag end, causing said bag to open.

6. The unpacking device arrangement according to claim 5 further comprising a staple penetrating said strip of tap secured to said bag end, such that staple legs simultaneously penetrate said strip and said bag end.

* * * * *